United States Patent [19]

Obayashi et al.

[11] 4,230,507

[45] Oct. 28, 1980

[54] METHOD FOR SULFURIZING CAST IRON

[75] Inventors: Mikio Obayashi, Nagoya; Naoyoshi Watanabe, Aichi, both of Japan

[73] Assignee: Kabushiki Kaisha Toyota Chuo Kenkyusho, Nagoya, Japan

[21] Appl. No.: 41,309

[22] Filed: May 22, 1979

[30] Foreign Application Priority Data

May 22, 1978 [JP] Japan ..... 53-60789

[51] Int. Cl.[2] ..... C23F 7/24

[52] U.S. Cl. ..... 148/6.11; 148/6.24

[58] Field of Search ..... 148/6.11, 6.24; 156/646, 642

[56] References Cited

U.S. PATENT DOCUMENTS 3,144,359 8/1964 Takahashi ..... 148/6.11

*Primary Examiner*—Ralph S. Kendall

*Attorney, Agent, or Firm*—Berman, Aisenberg & Platt

[57] ABSTRACT

Cast iron is pretreated in an aqueous solution of nitric acid and then immersed in molten sulfur until a sulfurized layer is formed on its surface. The sulfurized layer is very thick and stable and has excellent molten aluminum resistance. Its uniformity is further improved by a subsequent diffusion treatment at elevated temperatures.

7 Claims, 5 Drawing Figures

METHOD FOR SULFURIZING CAST IRON

BACKGROUND

Conventional methods of sulfurizing a cast iron material, to form a sulfurized layer (composed mainly of iron sulfide) on its surface, include (a) a high-temperature sulfurizing procedure in which the material is heated to about 570° C. using a suitable combination of, e.g., sodium cyanide (NaCN), potassium ferrocyanide [$K_4Fe(CN)_6$], sodium sulfite ($Na_2SO_3$), sodium thiosulfate ($Na_2S_2O_3$), ammonium sulfate [$(NH_4)_2SO_4$] and sodium sulfate ($Na_2SO_4$), and (b) a low-temperature sulfurizing procedure wherein the sulfurization is carried out at about 150° C. However, products of both of these procedures have only a thin (thickness of less than 10 microns) sulfide layer or a layer containing both a sulfide and a nitride. For this reason, such resulting layer has insufficient corrosion resistance to molten aluminum, notwithstanding its good wear resistance and seizure resistance. It is also difficult to obtain the desired sulfurized layer consistently, and these methods lack working stability.

A conventional sulfurizing method, involving pretreating the material with an iodine-alcohol solution, can result in a sulfurized layer having a thickness of as much as several tens of microns and superior resistance to molten aluminum. However, the use of iodine is undesirable from the standpoint of pollution control; and, since alcohol is flammable, its use is undesirable from the viewpoint of safety in operation.

SUMMARY OF THE INVENTION

This invention relates to a method of sulfurizing cast iron. The method removes the inconveniences encountered by corresponding previously-known treatments and imparts molten-aluminum resistance to the cast iron by a simple and inexpensive procedure.

Specifically, the present invention comprises a method for treating the surface of cast iron. It comprises (a) an optional initial step of degreasing the surface of the cast iron, (b) thereafter pretreatment by immersion in an aqueous solution of nitric acid and (c) a sulfiding treatment step during which the material, which has been subjected to the pre-treatment step, is held in molten sulfur to sulfide the surface layer of the material and thus to form a sulfurized layer. The surface-treating method of this invention permits the use of an aqueous solution of nitric acid, which is relatively easy to handle. The resulting sulfurized layer is very thick and stable; it has superior corrosion resistance to molten aluminum.

The surface treatment method of this invention is especially effective when applied to cast iron, but is similarly applicable to other materials, such as steel and alloy steels, to which conventional sulfurizing treatment methods are applied. When the surface treatment method of this invention is applied to cast iron, to steel and to alloy steels, far superior corrosion resistance to molten aluminum is imparted to the cast iron. It is not clear, however, why the method is more effective for cast iron than for the steel or alloy steels. It may be due to the presence of graphite in and the high silicon content of cast iron. Especially, in the case of flaky graphite cast iron, the present invention provides prominent corrosion resistance.

In applying a surface treatment to a material, it is the general practice to brush, pickle, or degrease the surface of the material in order to make it clean. In the present invention, however, treatments, such as brushing and pickling, are not required except where the material has heavy rust; simple degreasing ordinarily suffices. Degreasing is achieved, e.g., by immersing the material in a conventionally-known degreasing agent, such as trichloroethylene or ligroin, to dissolve (in the degreasing agent) oils and fats and thus to remove them from the surface of the material.

The degreased material is then immersed in an aqueous solution of nitric acid as pre-treatment (this treating step will be referred to hereafter as a pretreatment step). The pre-treatment step forms (on the surface of the material) a surface layer which is sulfided to form a sulfurized layer in a subsequent step. In the pre-treatment step of this invention, a surface layer composed mainly of a hydrate of iron is believed to be formed. The corrosion resistance of the sulfurized layer is dependent upon the properties of the surface layer obtained in the pre-treatment step. Specifically, corrosion resistance of the surface layer (after sulfurization) to molten aluminum is dependent upon the type, thickness, denseness (density or compactness), uniformity, etc., of that layer.

OBJECTS

An object of the present invention is to provide an improved treatment method for forming a thick and stable sulfurized layer on the surface of cast iron.

Another object of this invention is to provide a method for forming a sulfurized layer, which has excellent molten aluminum resistance.

A further object of this invention is to provide a method for forming a sulfurized layer by a simple, non-pollutant and inexpensive procedure.

A still further object of this invention is the resulting sulfurized cast iron having improved molten-aluminum resistance.

Additional objects of this invention are apparent from the presented details.

BRIEF DESCRIPTION OF THE DRAWINGS

FIG. 2 shows the cross-sectional structure of a material pre-treated with a 3 percent aqueous solution of nitric acid.

FIG. 3 shows the cross-sectional structure of a material obtained by further subjecting the material of FIG. 2 to a sulfiding treatment.

FIG. 4 shows the cross-sectional structure of a material obtained by further subjecting the material of FIG. 3 to diffusion treatment.

FIG. 5 shows the cross-sectional structure of a finally formed material when the pre-treatment is carried out with a 10 percent aqueous solution of nitric acid.

DETAILS

Figure 1:
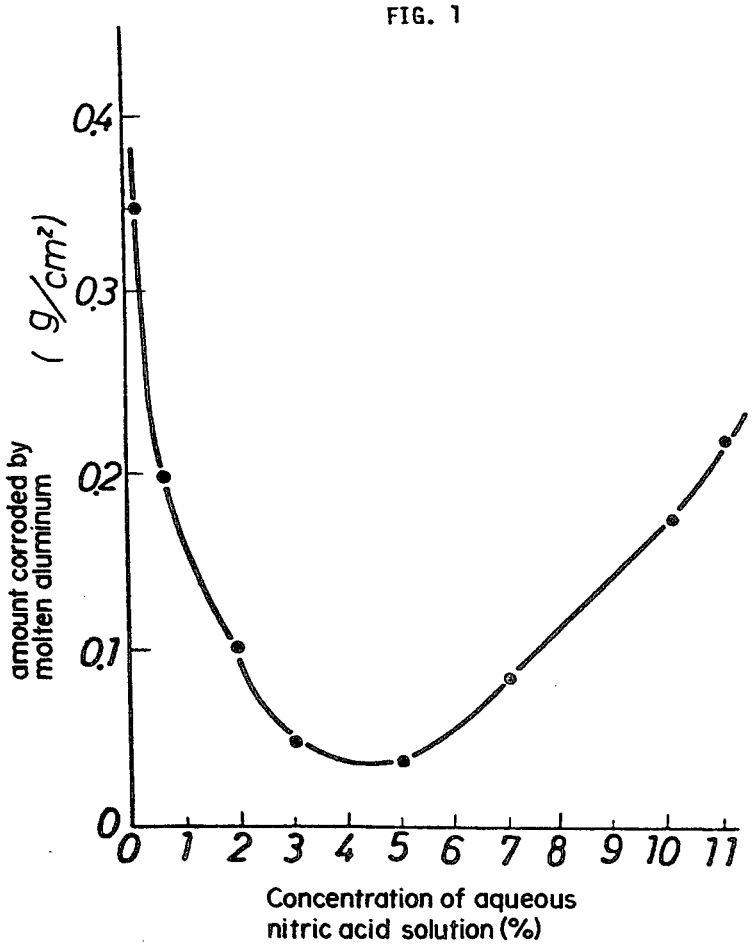
FIG. 1 shows the relation between the concentration of a pre-treating aqueous nitric acid solution and the amount of a material treated with an aqueous nitric acid solution that is corroded by molten aluminum.

The aqueous solution of nitric acid used in the pre-treatment step has a concentration of from 1 to 10 percent, preferably of from 2 to 7 percent. [A 1 percent aqueous solution of nitric acid means a solution consisting of 1 volume of concentrated nitric acid and 99 volumes of water ("percent" is used in this sense throughout this specification and appended claims).]

When the concentration of the aqueous nitric acid solution exceeds 10 percent, the material is dissolved vigorously during nitric-acid treatment. Although the finally-obtained sulfurized layer has sufficient thickness, it has low denseness or poor uniformity; a significant number of defects appear in its structure. On the other hand, when the concentration of the aqueous nitric acid solution is less than 1 percent, the resulting sulfurized layer may be sufficiently dense, but is not sufficiently thick. The corrosion resistance of the sulfurized layer is dependent upon its thickness, its denseness and its relative freedom from defects. Hence, except when using an aqueous nitric acid solution having a concentration of from 1 to 10 percent, the corrosion resistance of the sulfurized layer is not considered good. The corrosion resistance is excellent when the pre-treatment is carried out with an aqueous (from 2 to 7 percent) nitric acid solution.

The material is immersed in the aqueous solution of nitric acid in the pre-treatment step for a period of from 20 minutes to 3 hours. As a matter of course, the immersion time may be decreased as the concentration of the aqueous nitric acid solution is increased. The optimum immersion time specifically depends upon the concentration of the aqueous nitric acid solution and is determined accordingly. However, when the immersion time exceeds 3 hours, further immersion provides only a slight increase in the thickness of the finally-formed sulfurized layer and causes (a) defects in the structure of the sulfurized layer and (b) a reduction in its denseness, thus resulting in the deterioration of its corrosion resistance. When the immersion time is less than 20 minutes, the action of the aqueous nitric acid solution on the surface layer of the material is inadequate and, therefore, a sulfurized layer is not sufficiently formed during the sulfurizing treatment.

When an aqueous nitric acid solution of low concentration is used, the thickness of the sulfurized layer formed after the sulfurizing treatment is increased (to increase in its corrosion resistance) by blowing air into the nitric acid solution during pre-treating. The formation of an iron hydrate layer on the surface of the material is believed to be promoted by oxygen in the thus-employed air. An increase in the thickness of the sulfurized layer is also achieved by similarly blowing pure oxygen gas (instead of air) into the pretreating solution.

The treatment temperature in the pre-treatment step is, e.g., room temperature. Heating is not required, but treatment temperatures above room temperature are optionally employed. Effecting the pretreatment at a temperature in excess of room temperature promotes the reaction and has the advantage of shortening the pre-treatment time. Accordingly, the treatment temperature in the pre-treatment step of this invention is not limited to room temperature.

The pre-treated material is then immersed and held in molten sulfur (this treatment step will be referred to hereafter as a sulfiding treatment step). The purpose of the sulfiding treatment step is to convert the surface layer (composed mainly of a hydrate of iron and obtained by the pre-treatment) into a sulfide layer composed mainly of FeS or $FeS_2$. During this step the pretreatment material is immersed in molten sulfur, thus diffusing sulfur into the surface layer (composed mainly of an iron hydrate) and simultaneously reacting that layer with sulfur, thereby changing it into a sulfide layer composed mainly of iron sulfide. The treatment temperature in this step is preferably within the range of from 110° to 145° C. Sulfur is not molten at treating temperatures lower than 110° C. Treating temperatures of more than 145° C. are less desirable because the viscosity of sulfur is increased and adhesion of the sulfur to the surface of the material is impeded. Furthermore, there is a risk that the sulfur will catch fire at temperatures higher than 145° C. The immersion time is within the range of from 1 to 5 hours. Immersion for less than 1 hour does not permit sufficient impregnation of sulfur into the material. When immersion is performed for more than 5 hours, an increase in the thickness of the resulting sulfurized layer or an improvement in the quality of such sulfurized layer can no longer be expected.

In practice, it is beneficial to apply a diffusion treatment, a generally-known technique, to the material which has been subjected to the aforesaid pre-treatment step and the subsequent sulfiding treatment step. The diffusion treatment is generally performed by heating the material to a temperature ranging from 150° to 300° C. in a non-oxidizing atmosphere (e.g. $N_2$ or Ar) or under reduced pressure (e.g. $10^{-1}$ mm Hg). It serves to remove excess sulfur adhering to the surface of the material and to render the sulfide layer (formed in the previous step) uniform and dense. It is preferred to perform this step in a non-oxidizing atmosphere or under reduced pressure with little oxygen because it thus prevents corrosion (ascribable to the co-presence of sulfur and oxygen) of the material. Heating the material is effected at a temperature ranging from 150° to 300° C. The impregnation and reaction of sulfur are slow at temperatures below 150° C., and sulfur adhering to the surface of the material is not sufficiently removed. Temperatures above 300° C. are undesirable because the sulfide, itself formed on the surface of the material, also undergoes oxidation. Heating of the material is carried out for a period within the range of from 2 to 5 hours. When heating is effected for less than 2 hours, diffusion does not proceed. On the other hand, even when heating is continued for more than 5 hours, diffusion no longer proceeds.

Although such a diffusion treatment step is not always necessary, it is very effective for increasing the corrosion resistance of the material to molten aluminum because it has an effect of increasing the uniformity and denseness of the sulfurized layer on the surface of the material.

For example, the present inventors performed the following experiment. Two samples of a cast iron material (JIS FC-25, i.e. Japan Industrial Standards, gray iron casting, diameter of specimen as cast being 10 mm and tensile strength being above 28 kgf/mm$^2$), 10 mm in diameter and 40 mm in length, were subjected to (a) pretreatment by immersing them in a 5 percent aqueous solution of nitric acid for 1 hour and then to (b) a sulfiding treatment by immersing them in molten sulfur at 130° C. for 3 hours. One sample was subjected to (c) diffusion treatment at 200° C. for 3 hours under reduced pressure, and the other was not subjected to the diffusion treatment. The two samples were each immersed in molten aluminum for 150 hours to test the respective corrosion resistances of these two treated materials. While the material not subjected to diffusion treatment showed a corrosion loss of 0.07 g/cm$^2$, the material subjected to diffusion treatment showed a corrosion loss of as small as 0.04 g/cm$^2$. This shows that the corrosion resistance of the material can be increased by subjecting it to diffusion treatment. It is clear, however, from Table 1 that material pre-treated according to the present invention, but not subjected to diffusion treatment, has far better corrosion resistance than those materials which were pre-treated with other acids, such as sulfuric acid or hydrochloric acid.

The preceding description concerns the construction of the present invention. Now, the effects of the present invention are also significant.

Table 1 summarizes a comparison of the effect of the aqueous nitric acid solution used in the pre-treatment step of this invention with those of other similar aqueous solutions and that of non-treatment. In other words, it shows the corrosion resistances of the materials which were pre-treated with various solutions or not subjected to pre-treatment.

As an index showing the corrosion resistance of the sulfurized layer, the corrosion loss ($g/cm^2$) per unit surface area of the material which had been immersed in molten aluminum (JIS AC7A, i.e. Al-4.0 Mg) at 750° C. for 150 hours were employed. In this test, a cast iron material (JIS FC-25), 10 mm in diameter and 40 mm in length, was degreased and used as a sample. The pre-treatment was performed at room temperature for 1 hour using one of (a) a 5 percent aqueous solution of nitric acid, (b) a 3 percent aqueous solution of sulfuric acid, (c) a 3 percent aqueous solution of hydrochloric acid and (d) a 5 percent aqueous solution of acetic acid. The subsequent sulfiding treatment step was performed by immersing the sample (treated as indicated in the pre-treatment step) in molten sulfur at 130° C. for 3 hours. The non-treated sample was not subjected to pretreatment or to the sulfiding treatment. Each of the samples subjected to the sulfurizing treatment was subjected to diffusion treatment in air under reduced pressure of $10^{-1}$ mm Hg at 200° C. for 3 hours. Each of the samples was then subjected to the aforesaid corrosion resistance test. The non-treated sample completely disappeared before 100 hours elapsed. This corresponds to a corrosion loss of more than 1.6 $g/cm^2$. As is clear from Table 1, the samples pre-treated with sulfuric acid, hydrochloric acid or acetic acid showed increased corrosion resistance over the non-treated sample, but their corrosion resistances were far inferior to that of the sample pre-treated with nitric acid, and they had poor practicability. In contrast, when the pre-treatment was carried out using an aqueous nitric acid solution, the resulting product had excellent corrosion resistance to molten aluminum.

TABLE 1

| | | Amount of the material corroded ($g/cm^2$) |
|---|---|---|
| Type of the pre-treating solution | 5% aqueous nitric acid solution | 0.04 |
| | 3% aqueous sulfuric acid solution | 0.7 |
| | 3% aqueous hydrochloric acid solution | 0.4 |
| | 5% aqueous acetic acid solution | 0.9 |
| | Non-treated | more than 1.6 |

Table 2 shows the relation between the concentration of the pre-treating aqueous nitric acid solution and the amount of the material (treated with the aqueous nitric acid solution) corroded by molten aluminum. FIG. 1 shows the results of Table 2, plotting the concentration of the aqueous nitric acid solution on the abscissa and the amount of the material (treated with the aqueous nitric acid solution) corroded per unit surface area ($g/cm^2$) ion the ordinate. The data of Table 2 were obtained by using, as samples, cast iron materials subjected to the same pre-treatment, sulfiding treatment and diffusion treatment as in the case of the experiment shown in Table 1 except for the concentrations of the pre-treating aqueous nitric acid solutions and by testing the corrosion resistance of the samples to molten aluminum under the same conditions as in the case of the experiment shown in Table 1. As is clearly seen from Table 1, the amount of the non-treated cast iron sample corroded was more than 1.6 $g/cm^2$ in 100 hours. In contrast, when the material was treated with an aqueous nitric acid solution having a concentration of from 1 to 10 percent (immersion time being 150 hours) in accordance with this invention, the amount of corrosion was at most 0.2 $g/cm^2$, as is clear from FIG. 1. In particular, when a 2 to 7 percent aqueous solution of nitric acid was used, the samples had excellent corrosion resistance with a corrosion loss of not more than 0.1 $g/cm^2$.

TABLE 2

| | | Corrosion loss of the treated material ($g/cm^2$ |
|---|---|---|
| Concentration of the aqueous nitric acid solution | 0.5% | 0.35 |
| | 1% | 0.2 |
| | 2% | 0.1 |
| | 3% | 0.04 |
| | 5% | 0.04 |
| | 7% | 0.09 |
| | 10% | 0.18 |
| | 11% | 0.24 |

Figure 2:
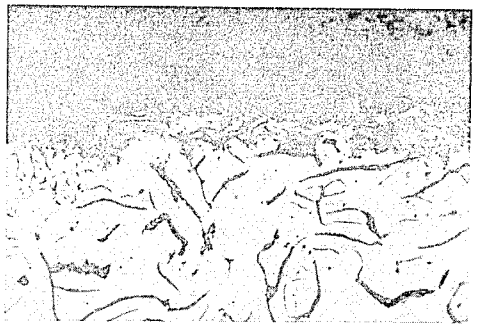
FIGS. 2 to 5 are microphotographs (×200) of the cross-sectional structures of the surfaces of materials.
Figure 3:
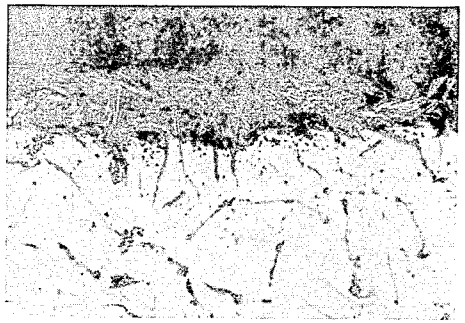

FIG. 2 shows the cross-sectional structure of the surface of the sample which was pre-treated with a 3 percent aqueous solution of nitric acid; FIG. 3, the cross-sectional structure of the sample which was further subjected to the sulfiding treatment step; and FIG. 4, the cross-sectional structure of the surface of the sample which was also subjected to the diffusion treatment, all by a microphotograph at the same magnification (200 magnifications). Unlike FIG. 2, FIG. 3 shows that a good sulfurized layer is formed. It is believed that, owing to the presence of such a sulfurized layer, the material exhibits excellent corrosion resistance to molten aluminum.

Figure 4:
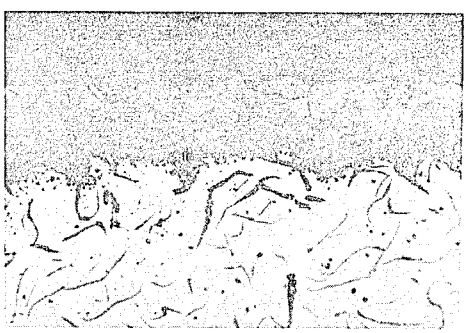
Figure 5:
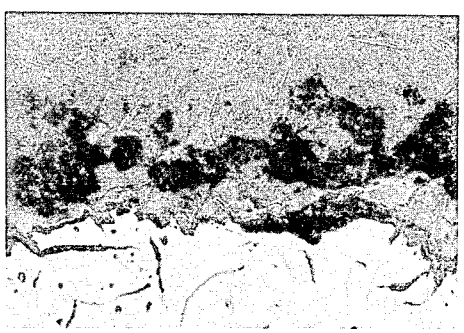

These series of experiments also clearly show that the thickness of the sulfurized layer formed on the surface of the material increases with increasing concentration of the aqueous nitric acid solution. For example, when the pre-treatment was performed for 60 minutes using a 1 percent aqueous nitric acid solution, a sulfurized layer of from 20 to 30 microns in thickness was finally formed; in the case of a 2 percent aqueous nitric acid solution, a sulfurized layer having a thickness of about 60 microns was obtained; and in the case of a 10 percent aqueous nitric acid solution, a sulfurized layer having a thickness of 150 microns was obtained. It has been made clear, however, that the corrosion resistance is not necessarily proportional to the thickness of the sulfurized layer. When the concentration of the aqueous nitric acid solution exceeds 5 percent, the thickness of the sulfurized layer increases. However, the amount of the treated material corroded increases, and its corrosion resistance is reduced. FIG. 5 shows a microphotograph of the structure of the finally obtained sulfurized layer formed on the surface of the material which was treated with a 10 percent aqueous nitric acid solution but, otherwise, treated under quite the same treating conditions as in the material shown in FIG. 4. It is seen from FIGS. 4 and 5 that the material pre-treated with a 10 percent aqueous nitric acid solution (FIG. 5) had a thicker sulfurized layer. However, the sulfurized layer did not have a sound structure due to many defects (black portions in the photograph).

Furthermore, the thickness of the sulfurized layer increases as the time for immersing the material in the aqueous nitric acid solution increases. For example, when pre-treatment is carried out using a 7% aqueous solution of nitric acid for an immersing time of 20 minutes, the thickness of the sulfurized layer is from about 50 to 90 microns. However, when the immersion is carried out for 60 minutes, the thickness reaches 150 microns. The amount of the material corroded, however, is not necessarily small even when the sulfurized layer has a large thickness. For example, the amount corroded from the material having a 150 micron-thick sulfurized layer is from 0.1 to 0.2 g/cm$^2$, but some samples having a sulfurized layer with a thickness of from 50 to 90 microns have an amount of corrosion of only 0.05 g/cm$^2$, which is less than one half that of the material having the thicker sulfurized layer.

From the foregoing, it is clear that the corrosion resistance (of a cast iron material).to molten aluminum is primarily affected by the thickness of the sulfurized layer, but is also dependent on various other conditions, such as the number of defects in the structure of the sulfurized layer or the degree of denseness and adhesion of the structure, as well as the uniformity of the thickness of the layer. Thus, in order to obtain material with a sulfurized layer having good corrosion resistance to molten aluminum, it is desirable to effect a pre-treatment by immersing the material in an aqueous solution of nitric acid (having a concentration of from 1 to 10 percent) for a period of from 20 minutes to 3 hours.

When the pre-treatment is performed with a 1 percent aqueous nitric acid solution, the resulting sulfurized layer has a thickness of from 20 to 30 microns. However, when the pre-treatment is carried out while blowing air (e.g. 1 l/min.) or pure oxygen gas into the aqueous nitric acid solution, a sulfurized layer having a thickness of about 70 microns is obtained. The thus-pretreated and coated material has an increased corrosion resistance corresponding to the increase in thickness.

EXAMPLE 1

This illustrates the practice of the present invention on a cast iron ladle for an aluminum die casting machine. Conventionally, this ladle has been produced from cast iron and coated with a commercially available facing material. The average life of this ladle is about two months.

A ladle made of the same conventional cast iron (JIS FC-25, capacity about 10 liters) was used. The scale was simply shaved off of the ladle, and the ladle was then washed and degreased with trichloroethylene. It was then immersed for two hours in a 5 percent aqueous solution of nitric acid to form a surface layer on the surface of the ladle. It was then immersed for four hours in molten sulfur at 130° C. to sulfide the surface layer and thus form a sulfide layer. The ladle was further subjected to diffusion treatment under reduced pressure at 170° C. for five hours. The same conventional facing material was coated on the surface of the resulting ladle, and it was used in aluminum die casting. The aluminum was JIS ADC10 (Al-9%Si-3% Cu type aluminum alloy die casting). The ladle treated by the method of this invention could be used for about 6 months. Thus, it became clear that it has about three times as long a life as the conventional one.

EXAMPLE 2

The same ladle for an aluminum die casting machine as used in Example 1 was subjected to the pre-treatment and sulfiding treatment under the same conditions as in Example 1. Without subjecting the treated ladle to diffusion treatment, its surface was coated with the same conventional facing material, and the coated ladle was used for aluminum die casting. As a result, the ladle could be used for about 4 months, and thus it became clear that it had two times as long a life as the conventional one.

As previously described in detail, the present invention performs effective sulfurization by degreasing the surface of a cast iron material, immersing it in an aqueous nitric acid solution as a pre-treatment step, and then subjecting the material to a sulfiding treatment step by holding it in molten sulfur, thereby forming a sulfide layer on the surface of the material. The operations of these treating steps are very simple, and a thick sulfurized layer is formed economically. The sulfurized layer on the surface of the material which is formed by such a sulfurizing method has excellent corrosion resistance to molten aluminum.

Furthermore, by subjecting the material, after such a sulfiding treatment step, to a diffusion treatment by heating it in a non-oxidizing atmosphere or under reduced pressure, the sulfurized layer formed on the surface of the material is stabilized, made dense, and simultaneously freed from sulfur adhering to the surface of the material, thus further increasing corrosion resistance.

The present invention, having such effects, is particularly suitable for the surface treatment of, for example, a ladle for an automatic molten metal supplying device of a die casting machine, a thermocouple protecting tube of an aluminum melting furnace, or a stalk for low-pressure die casting.

In each of FIGS. 2 through 5, the upper black portion shows a resin; the lower white portion shows the substrate (ferrite and graphite); and the grey portion therebetween shows the surface layer formed. The small, round black portions show voids, while the flake-like black portions show graphite.

FIG. 2 shows a layer probably composed mainly of a hydrate of iron. FIG. 3 shows a thick sulfurized layer composed mainly of iron sulfide (S, $FeS_2$, FeS, $Fe_3C$, graphite and $\alpha$-Fe have been recognized through X-ray diffraction analysis). FIG. 4 shows a thicker sulfurized layer composed mainly of iron sulfide being uniform and dense as a result of a diffusion treatment (through the analysis, no sulfur, less $FeS_2$, more FeS, $Fe_3C$, graphite and less $\alpha$-Fe have been recognized). FIG. 5 shows a still thicker sulfurized layer but with more voids.

The preceding text amply teaches those having any familiarity with the present art how to practice the described invention to the fullest extent. Numerous apparent variations are readily made in the procedures or their combinations, with corresponding changes in the resulting products, without departing from the spirit or scope of the present disclosure.

What is claimed is:

1. A method for sulfurizing cast iron, which comprises the steps of pre-treating cast iron material by immersing the material in an aqueous nitric acid solution consisting essentially of nitric acid and water for a period of from 20 minutes to 3 hours, the concentration of nitric acid in said solution being from 1 to 10 percent by volume, and thereafter sulfiding the material in molten sulfur, thereby forming a sulfurized layer on the surface of the material.

2. A method according to claim 1, wherein the concentration of nitric acid in said aqueous solution is from 2 to 7 percent.

3. A method according to claim 1, wherein the temperature of the nitric acid solution in the pre-treating step is room temperature.

4. A method according to claim 1, wherein the pre-treating step comprises blowing air or oxygen gas into the aqueous nitric acid solution.

5. A method according to claim 1, wherein the sulfiding comprises immersing the material in molten sulfur for from 1 to 5 hours at a temperature ranging from 110° to 145° C.

6. A method according to claim 1, which further comprises heating the resulting material at a temperature within a range of from 150° to 300° C. to make uniform the sulfide layer from the resulting sulfiding step.

7. A method according to claim 6 which comprises effecting the heating in a non-oxidizing atmosphere or under reduced pressure.

* * * * *